US006651809B2

(12) United States Patent
Holler

(10) Patent No.: US 6,651,809 B2
(45) Date of Patent: Nov. 25, 2003

(54) APPARATUS AND METHOD FOR CIGAR STORAGE

(76) Inventor: Christopher A. Holler, 2449 Via Sienna, Winter Park, FL (US) 32789

( * ) Notice: Subject to any disclaimer, the term of this patent is extended or adjusted under 35 U.S.C. 154(b) by 116 days.

(21) Appl. No.: 09/928,861

(22) Filed: Aug. 13, 2001

(65) Prior Publication Data

US 2003/0029744 A1 Feb. 13, 2003

(51) Int. Cl.[7] ..... B65D 81/28

(52) U.S. Cl. ..... 206/213.1; 206/256; 131/274; 312/31.3

(58) Field of Search ..... 206/256, 257, 206/258, 242, 205, 213.1; 131/274, 275; 220/315, 323, 378, 507, 528, 795; 312/31, 31.1, 31.2, 31.3

(56) References Cited

U.S. PATENT DOCUMENTS 1,678,260 A * 7/1928 Martino et al. ..... 312/31.1
1,791,417 A * 2/1931 Lilienfield ..... 206/256
2,821,448 A * 1/1958 Bender ..... 312/31
3,819,040 A * 6/1974 Coons ..... 220/378
3,826,358 A * 7/1974 Butler et al. ..... 312/31
4,793,478 A * 12/1988 Tudor ..... 206/256
5,794,771 A * 8/1998 Krawec et al. ..... 206/256
5,829,581 A * 11/1998 Wicker ..... 206/256
5,901,710 A 5/1999 Barber
D410,566 S 6/1999 Bartolotta
6,000,585 A * 12/1999 Stewart et al. ..... 220/378
D419,260 S 1/2000 Manzo, Jr.
6,068,113 A 5/2000 Schmaling et al.
D428,195 S 7/2000 Knudsen

* cited by examiner

*Primary Examiner*—Luan K. Bui
(74) *Attorney, Agent, or Firm*—Allen, Dyer, Doppelt, Milbrath & Gilchrist, P.A.

(57) ABSTRACT

An apparatus for cigar storage preferably includes a main body container having a bottom, side portions connected to and extending upwardly from the bottom, and a plurality of cigar storage compartments formed within the main body and within the confines of the side portions and each having an open upper end thereof to position a cigar therein. The cigar storage compartments advantageously protect each individual cigar from damage, contamination, moisture, such as during travel, extensive use, toting, or other uses of the apparatus. The apparatus also preferably has a container lid positioned to overlie upper portions of the main body container when in a closed position to thereby cover the open upper end of each of the plurality of cigar storage compartments, and a cigar dispenser having portions thereof positioned within the main body container and responsive to a user to display and dispense each of the cigars positioned within the plurality of cigar storage containers.

31 Claims, 7 Drawing Sheets

APPARATUS AND METHOD FOR CIGAR STORAGE

FIELD OF THE INVENTION

The present invention relates to the cigar industry and, more particularly, to the field of cigar humidors and methods of storing cigars.

BACKGROUND OF THE INVENTION

Numerous humidors, cigar cases, and other cigar storage containers, devices and systems have been developed over the years. These cigar storage containers have widely varied in shape and size. Some containers, for example, have been known for travel which have an elongate shape with a screw-on top and holds only one or a small number of cigars such as shown in U.S. Pat. No. Des. 428,195 titled "Cigar Case" by Knudsen. Other cigar storage containers for travel have a substantially rectangular shape with a zip-open top and are lined with cedar strips such as shown in U.S. Pat. No. 6,068,113 titled "Portable Humidor" by Schmaling et al. Other shapes for cigar storage containers, such as coffin shaped as shown in U.S. Pat. No. Des. 419,260 titled "Cigar Humidor" by Manzo, Jr. and barrel shaped as shown in U.S. Pat. No. Des. 410, 566 titled "Cigar Humidor" by Bartolotta, have been known as well. Also, flavor additives have been known for introducing into containers such as described in U.S. Pat. No. 5,901,710 titled "Cigar Enhancing Humidor" by Barber. All of these containers, however, either only hold one cigar or place all the cigars into a common storage chamber. This encourages over-packing of containers which can damage the cigars and reduces the sealed confinement of the individual cigars when positioned in the chamber. Also, when selecting a cigar from the container, the user is required to pilfer through the various cigars to make a desired selection such as when a child places his hand in a cookie jar and pilfers through the cookies trying to find the biggest one or the one with the most chocolate. Many cigars, cigar producers, and cigar sellers, in contrast to cookies, have been obtaining and continue to try to obtain a classier image among purchasers. Accordingly, a cookie jar approach to storing and selecting cigars can provide an image, and perhaps often actually be, of unsanitary, damaged or used goods, or not caring about the cigars themselves, the user, or the one being offered a cigar. Also, because many types of cigars can be expensive, damaged cigars can be costly and unsightly to a user.

SUMMARY OF THE INVENTION

With the foregoing in mind, the cigar storing apparatus and associated methods of the present invention advantageously allows a user to store a plurality of cigars in individually confined areas to thereby protect each cigar individually. This individual protection also advantageously allows individual applications such as scenting or flavoring to be done as groups or individually. The cigar storing apparatus and associated methods of the present invention additionally advantageously allow a plurality of cigars to be displayed at one time by a user and to make an individual selection without damaging or contaminating other cigars being stored. Accordingly, if a particular cigar from the Dominican Republic or Cuba is being offered in a selection with other cigars from other countries and a user desires that particular cigar type, for example, the one being offered the cigar can readily make the selection with a substantially reduced risk of contacting the other cigars being offered. The cigar storing apparatus further advantageously provides a compact and organized way to store a plurality of cigars in an air tight container.

More particularly, the present invention provides an apparatus for storing cigars that preferably has a main body container having a bottom, side portions connected to and extending upwardly from the bottom, and a plurality of separate, individual and elongate cigar storage compartments formed within the main body and within the confines of the side portions and each having an open upper end thereof to position a cigar therein. The separate and individual storage compartments advantageously protect each individual cigar from damage, contamination, moisture, and other aspects such as during travel, extensive use, toting, or other uses of the apparatus. The apparatus also preferably has a container lid positioned to overlie upper portions of the main body container when in a closed position to thereby cover the open upper end of each of the plurality of cigar storage compartments and a cigar dispenser having portions thereof positioned within the main body container and responsive to a user to display and dispense each of the cigars positioned within the plurality of cigar storage containers.

The apparatus according to the present invention can also advantageously have a lid fastener associated with the container lid and the main body container to thereby secure the container lid to the main body container and a seal positioned to contact the container lid and upper portions of the main body contact to thereby assist in forming a gaseous tight container so that when the lid is secured to the main body container various gases are not able to reach cigars when positioned within the plurality of cigar storage compartments. The main body container also preferably has a substantially solid medial portion positioned within the confines of the side portions into which the plurality of cigar storage compartments are formed. The substantially solid medial portion of the main container body preferably includes a bore formed therein in a medial portion thereof extending from an upper end of the main container body to adjacent the bottom thereof. The cigar dispenser can advantageously have major portions thereof positioned within the bore and responsive to a user to display and dispense each of the cigars positioned within the plurality of cigar storage containers. Advantageously, for ease of manufacturing, aesthetics, additional freshness protection, or other desired features, the bottom and side portions can be formed of a different material than the substantially solid medial portion of the same material.

According to the present invention, the cigar dispenser preferably includes a handle rod positioned within the bore and having an upper end portion positioned to be gripped by a user and a lower end portion positioned adjacent the bottom when in a lowered position. The lower end portion preferably extends upwardly away from the bottom and through the bore when in a raised position. The cigar dispenser also preferably includes a plurality of cigar contact rod members connected to and extending outwardly from the handle rod and each to a respective one of plurality of cigar storage compartments and each positioned to underlie a respective one of the cigars so that when the handle rod is gripped and raised by a user at least portions of upper ends of the cigars extend upwardly through the open upper end of the plurality of cigar storage compartments preferably for simultaneously displaying and dispensing to a user. The cigar dispenser, for example, can have an umbrella-frame type appearance which has a main rod member and a plurality of finger rod members connected to the main rod member and extending outwardly therefrom. This advantageously allows all of the cigars to be raised and displayed at one time, e.g., simultaneously. The user can then readily select one of the displayed cigars for use without contacting the other cigars and yet can determine if the type of cigar the user likes is among the selection being displayed.

The present invention still further includes a method of displaying and dispensing cigars which preferably includes positioning a plurality of cigars in a cigar storage container so that the plurality of cigars are each substantially hidden from ready viewing and raising a cigar dispenser to a desired height responsive to a user so that portions of each of the plurality of cigars are readily visible to the user. The step of raising a cigar dispenser preferably includes gripping the cigar dispenser by a hand of a user and lifting the cigars by the cigar dispenser to the desired height. The method can also include selecting one of the plurality of cigars for use by gripping the cigar with the other hand of the user when the plurality of cigars are being viewed.

Advantageously, an apparatus and methods for storing cigars of the present invention allows a plurality of cigars to be stored in an individually protective environment and yet be readily displayed and dispensed to a user. The individual storage further advantageously allows the owner of the apparatus to selectively arrange or store cigars in preselected patterns, e.g., groups, rows, or positions, so that when the owner desires a type of selection, the apparatus can readily be positioned to provide access to that owner or the guest being offered a cigar. Still further, the compact and portable nature of the apparatus allows it to be manufactured as a portable travel container, such as for business, hunting, fishing, or camping, or to be used as a prominent display container such as on a desk, tabletop, or a bookshelf and yet have all of the other advantages as described herein.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

Figure 1:
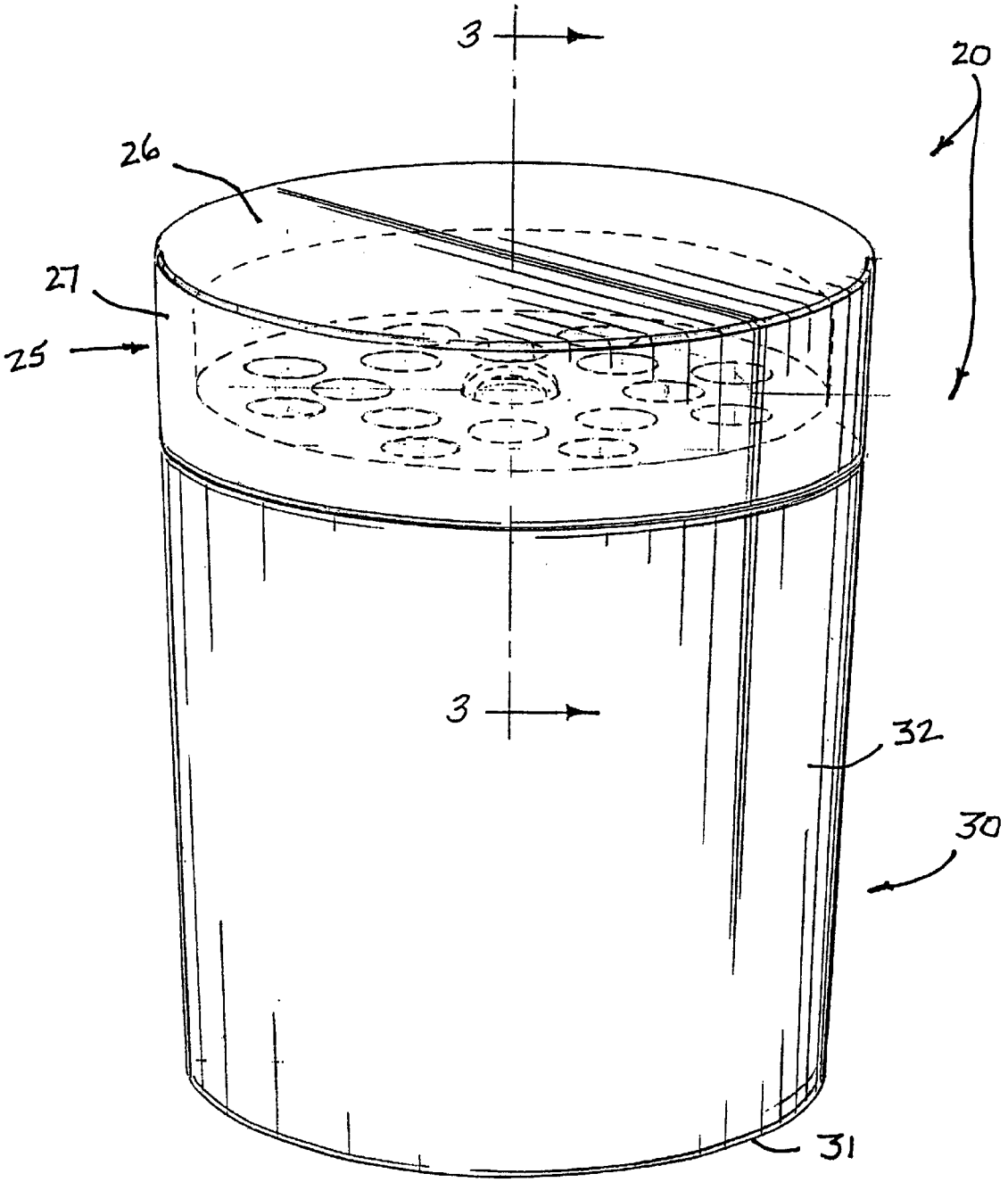
FIG. 1 is a perspective view of a cigar storing apparatus according to a first embodiment of the present invention.
Figure 2:
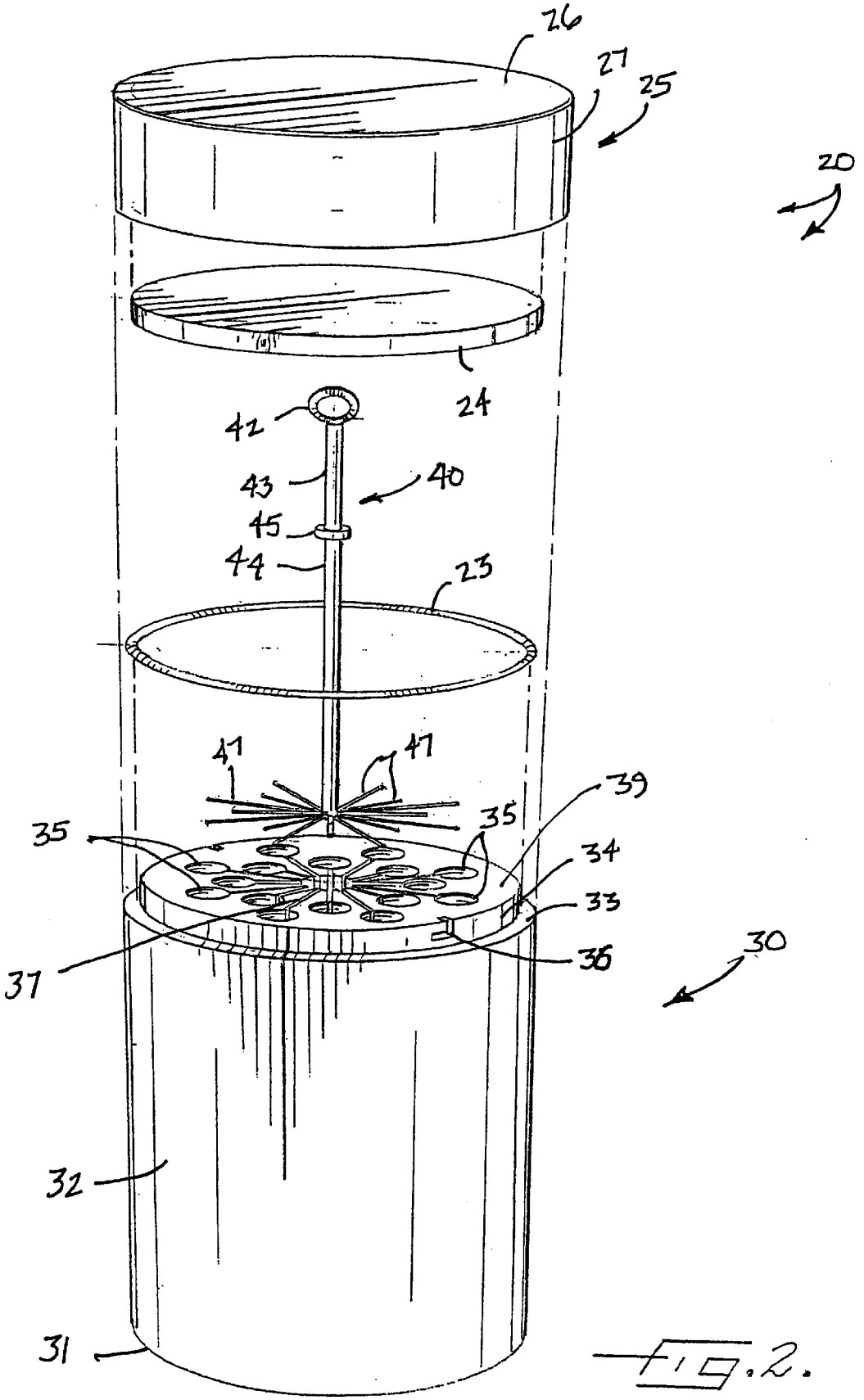
FIG. 2 is an exploded perspective view of cigar storing apparatus according to a first embodiment of the present invention.
Figure 4:
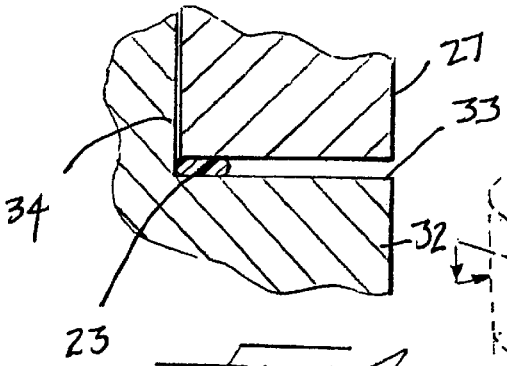
FIG. 4 is an enlarged cross-sectional view of a portion of a lid and container seal of a cigar storing apparatus according to a first embodiment of the present invention.
Figure 5:
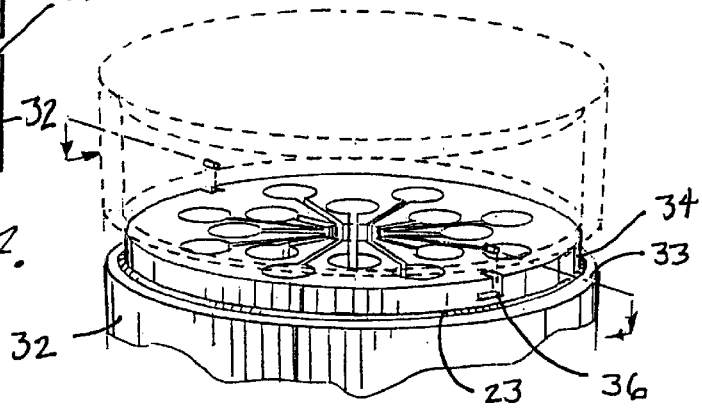
FIG. 5 is a perspective view of an upper portion of a container and a lid shown with phantom lines of a cigar storing apparatus according to a first embodiment of the present invention.
Figure 3:
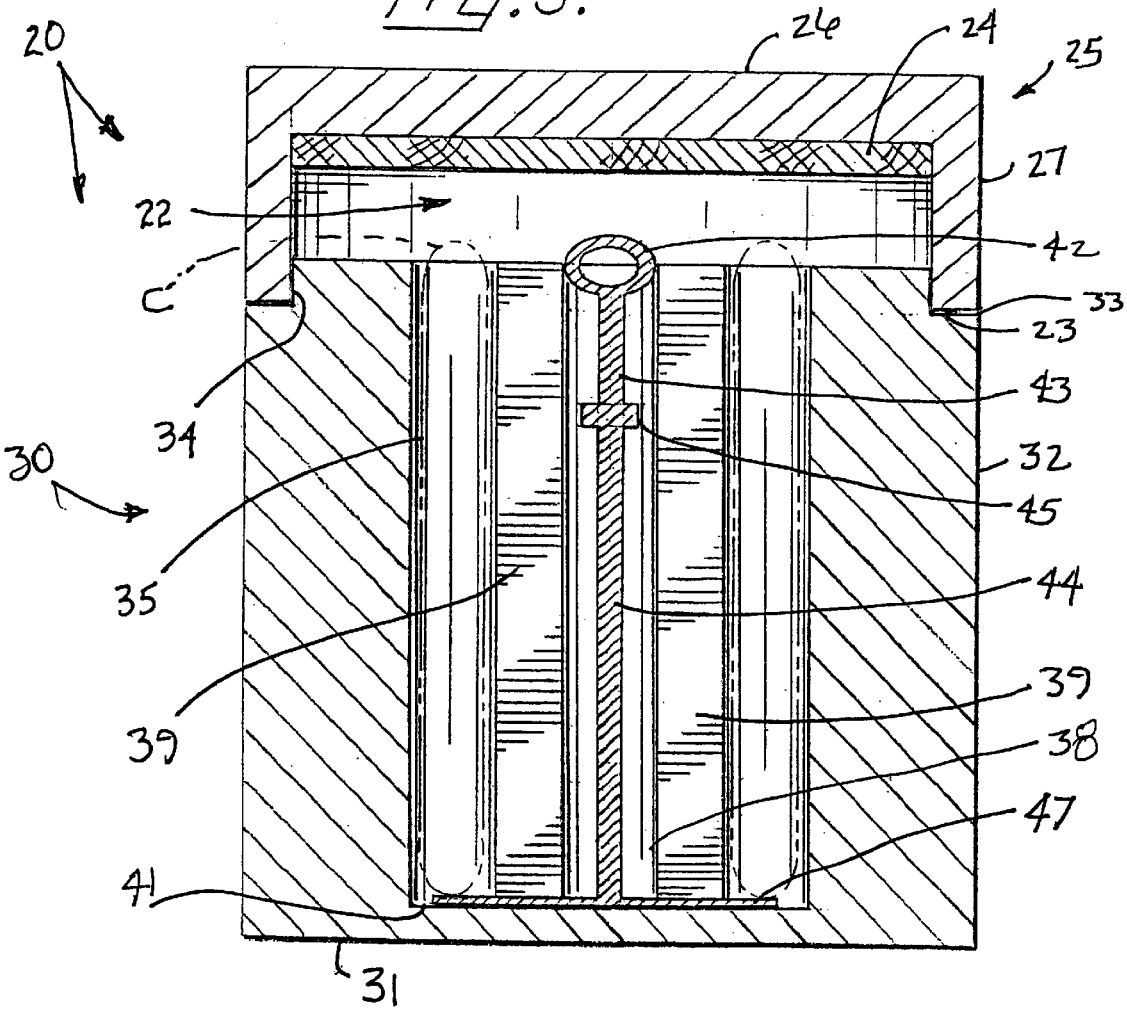
FIG. 3 is a cross-sectional view of a cigar storing apparatus taken along line 3—3 of FIG. 1.
Figure 6:
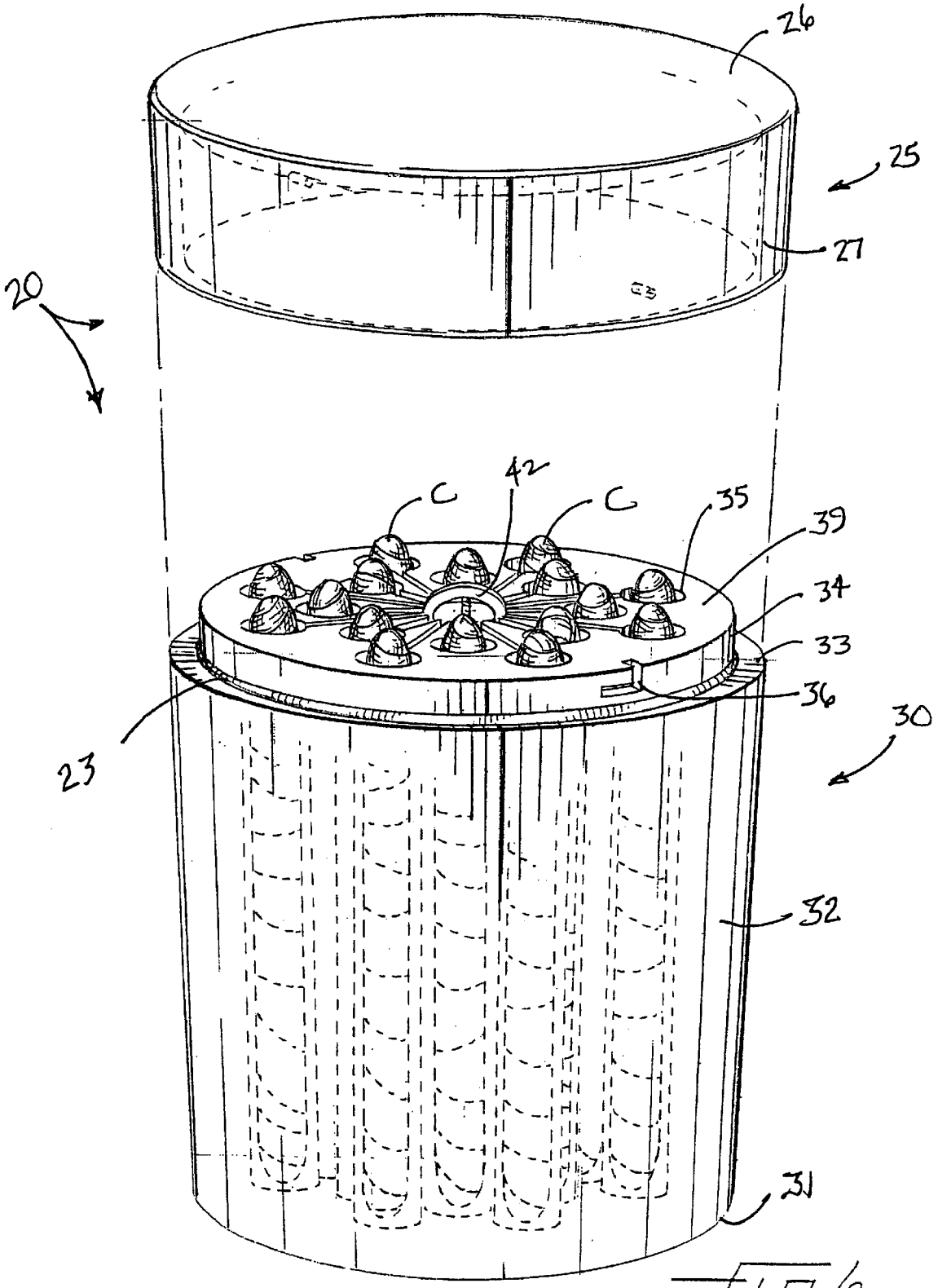
FIG. 6 is an exploded perspective view of a cigar storing apparatus have having a plurality of cigars positioned therein in individual storage compartments according to a first embodiment of the present invention.
Figure 7:
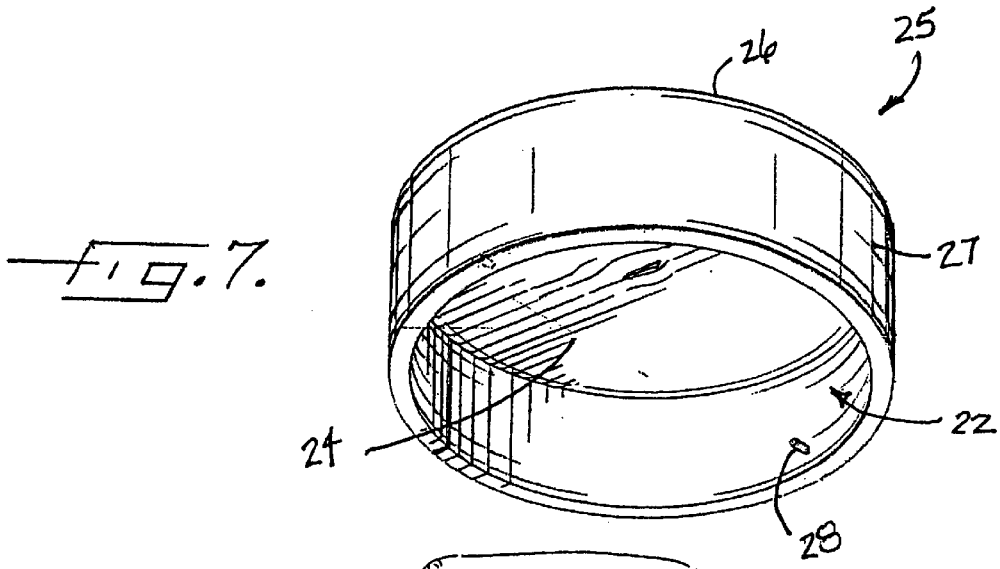
FIG. 7 is a perspective view of a lid of a cigar storing apparatus according to a first embodiment of the present invention.
Figure 8:
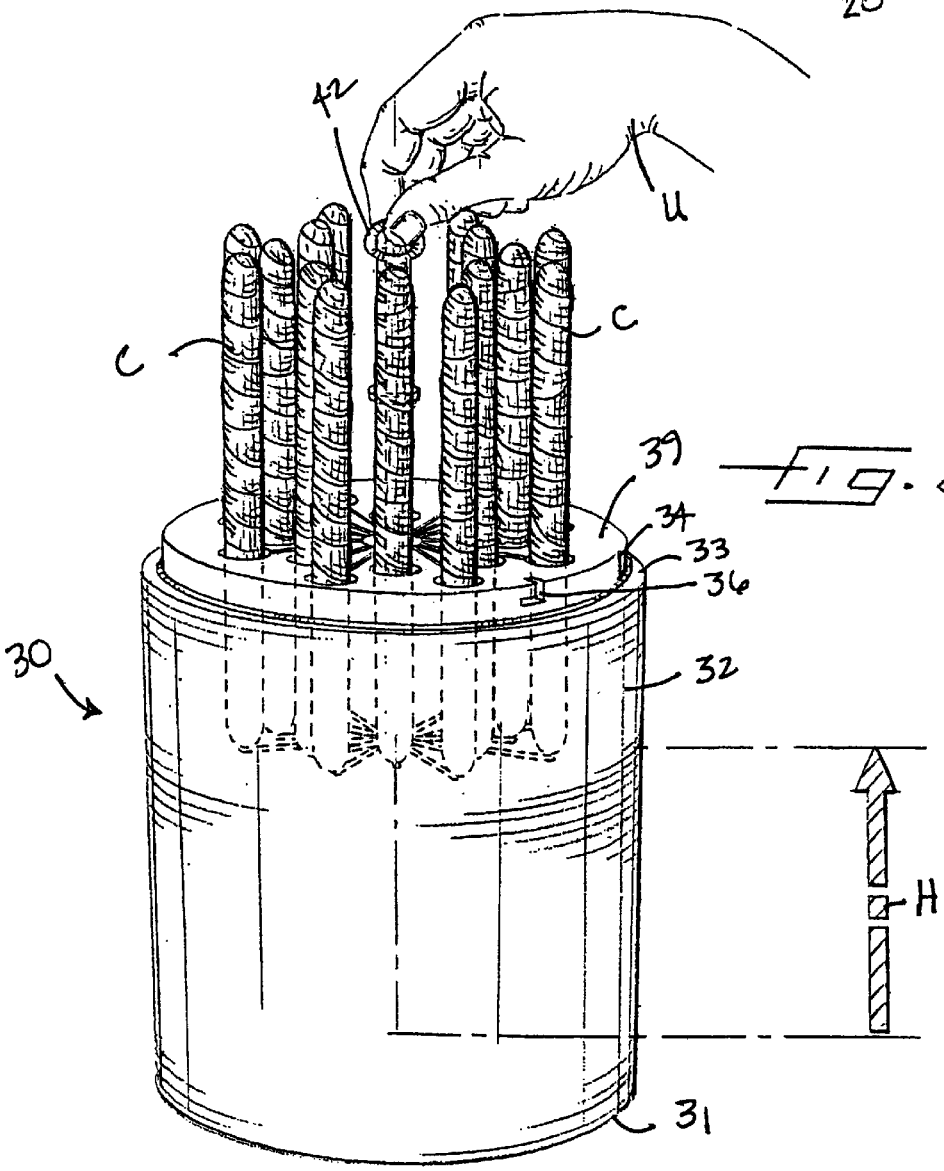
FIG. 8 is a perspective view of a container having a plurality of cigars positioned therein and being raised by a cigar dispenser for viewing or selecting a cigar from the container of a cigar storing apparatus according to a first embodiment of the present invention.
Figure 9:
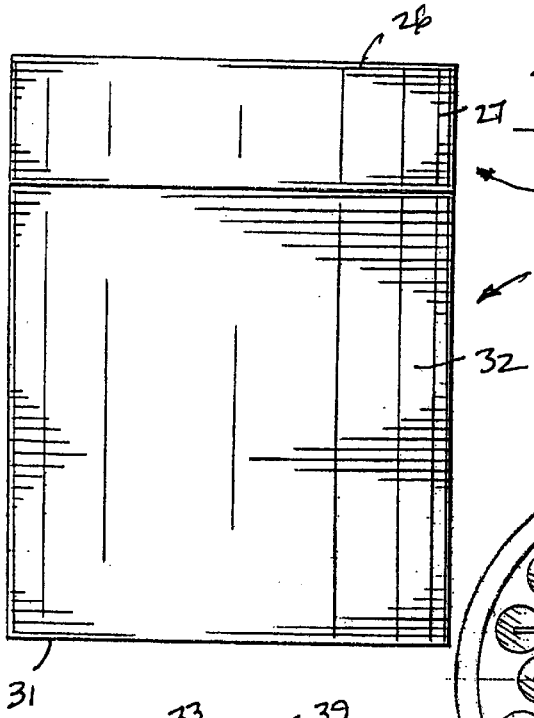
FIG. 9 is a side elevational view of a cigar storing apparatus according to a first embodiment of the present invention.
Figure 12:
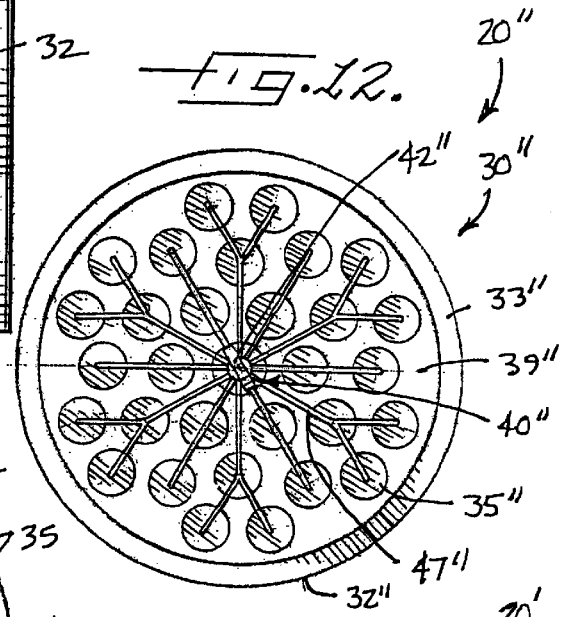
FIG. 12 is a top plan view of a cigar storing apparatus without a lid positioned thereon according to a third embodiment of the present invention.
Figure 10:
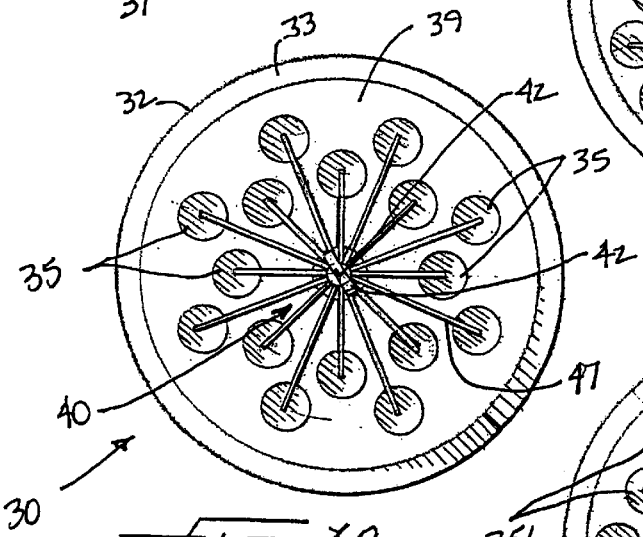
FIG. 10 is a top plan view of a cigar storing apparatus without a lid positioned thereon according to a first embodiment of the present invention.
Figure 11:
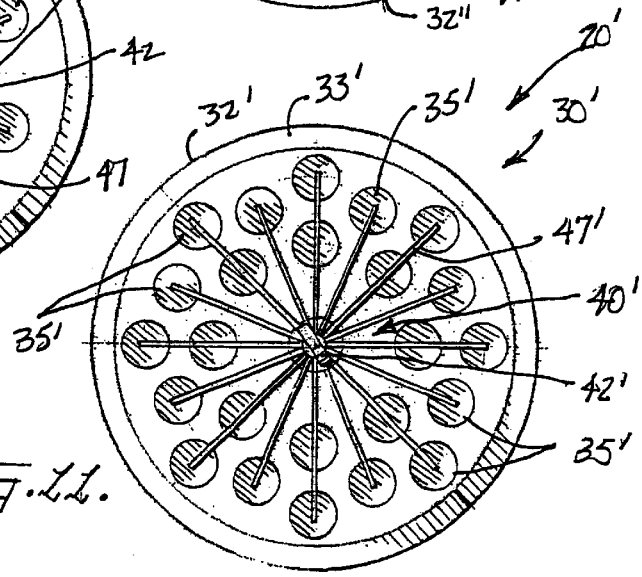
FIG. 11 is a top plan view of a cigar storing apparatus without a lid positioned thereon according to a second embodiment of the present invention.

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout; the prime notation, if used, indicates similar elements in alternative embodiments.

FIGS. 1–10 illustrate illustrate a cigar storing apparatus 20 according to a first embodiment of the present invention which preferably has a main body container 30 having a bottom 31, side portions 32 connected to and extending upwardly from the bottom 31, e.g., rounded, cylindrical, or other shapes, a substantially solid medial portion 39 positioned within the confines of the side portions 32, and a plurality of separate, individual and elongate cigar storage compartments 35 formed within the substantially solid medial portion 39 of the main body 30 and within the confines of the side portions 32. Each of the cigar storage compartments 35 preferably has an open upper end thereof to position a cigar C therein. A container lid 25 is preferably positioned to overlie upper portions of the main body container 30 when in a closed position to thereby cover the open upper end of each of e plurality of cigar storage compartments 35. The container lid also preferably has a lid chamber 22 formed therein and positioned within the confines of a top 26 of the lid 25 and side portions 27 of the lid 25. The apparatus 20 also preferably includes a lid fastener 28 associated with the container lid 25 and the main body container 30 to thereby secure the container lid 25 to the main body container 30 and a seal 23 positioned to contact the container lid 25 and upper portions of the main body contact to thereby assist in forming a gaseous tight container so that when the lid 25 is secured to the main body container 30 various gases are not able to reach cigars C when positioned within the plurality of cigar storage compartments 35. These gases otherwise, for example, can damage or contaminate the flavor or freshness of the cigars C.

As shown in FIGS. 2–6 and 8, the seal 23 preferably has a shape that corresponds to the shape of the outer perimeter of the main container body 30 and container lid 25. For example, if the outer perimeter or overall shape is substantially cylindrical or annular, then the seal 23 preferably has a substantially annular shape, e.g., circular, oval, oblong, or close to such shapes when viewed as a whole, is positioned on the lip and abuttingly contacts the peripheries of the container lip 33 when positioned on the main container body 30 in the closed position. The seal 23 can be an O-ring formed of an elastomeric material or other sealing material as understood by those skilled in the art. Other shapes of the apparatus 20, e.g., main container body 30 and container lid 25, can be used as well such as rectangular, diamond, pentagon, star, and various substantially annular shapes as described above and as understood by those skilled in the art. Accordingly, the seal 23 preferably has a shape that traces the lip 33, and it will be recognized by those skilled in the art that the shape of the container and lip 33 can vary or be different from each other as well according to the present invention. The container lid 25 can also advantageously include an inner aroma protection layer 24 preferably including a wood material positioned to be adjacent and overlie the open upper end of each of the plurality of cigar storage compartments 35. The inner layer 24, for example, can be formed of a cedar material to enhance the freshness and absorb unwanted gases or aromas which could damage or contaminate the taste of the cigars C stored therein. This layer 24 thereby further enhances the sealing freshness of the cigars C stored in the apparatus 20.

The apparatus 20 further preferably has a cigar dispenser 40 preferably having portions thereof, and more preferably major portions such as perhaps best illustrated in FIGS. 2, 3, 8, and 13, positioned within the main body container 30 and responsive to a user U to display and dispense each of the cigars C positioned within the plurality of cigar storage containers. As perhaps best shown in FIGS. 3 and 10–13, the main container body 30 preferably includes a bore 38 formed therein, and preferably within the medial portion 39 thereof, extending from an upper end of the main container body 30 to adjacent the bottom 31 thereof. The cigar dispenser 40 preferably includes a handle rod preferably formed of a finger pull 42, a first rod portion 43 connected on a first end to the finger pull 42, and a second rod portion 44 connected to the second end of the first rod portion 43. The handle rod is positioned within the bore 38 and has an upper end portion, e.g., the finger pull 42, positioned to be gripped by a user U and a lower end portion, e.g., the second rod portion 44, positioned adjacent the bottom 31 when in a lowered position and the lower end portion extending upwardly away from the bottom 31 and through the bore 38 when in a raised position. A rod flange 45 can also be connected to or between the first and second rod portions 43, 44 of the handle rod to provide enhanced stability to the handle rod and as a protective guide through the bore 38. The cigar dispenser 40 also preferably includes a plurality of cigar contact rod members, e.g., finger members 47, connected to and extending outwardly from the handle rod and each to a respective one of plurality of cigar storage compartments 35. Each of the finger members 47 are preferably positioned to underlie a respective one of the cigars C so that when the handle rod is gripped and raised by a user U at least portions of upper ends of the cigars C extend upwardly through the open upper end of the plurality of cigar storage compartments 35 preferably for simultaneously displaying and dispensing to a user U.

As perhaps best shown in the first, second, third, and fourth embodiments of the apparatus 20, 20', 20", 20'" in FIGS. 2, 8, and 10–13, the cigar dispenser 40, 40', 40", 40'", for example, can have an umbrella-frame type appearance which has a main rod member, e.g., including the finger pull 42, 42', 42" and the second rod portion 44, 44'" as well as the other portions described above, and a plurality of finger rod members 47, 47', 47", 47'" connected to the main rod member and extending outwardly therefrom. This advantageously allows all of the cigars C to be raised to a desired height H (see, e.g., FIG. 8) and displayed at one time. The user U can then readily select one of the displayed cigars C for use without contacting the other cigars C and yet can determine if the type of cigar C the user U likes is among the selection being displayed.

Figure 13:
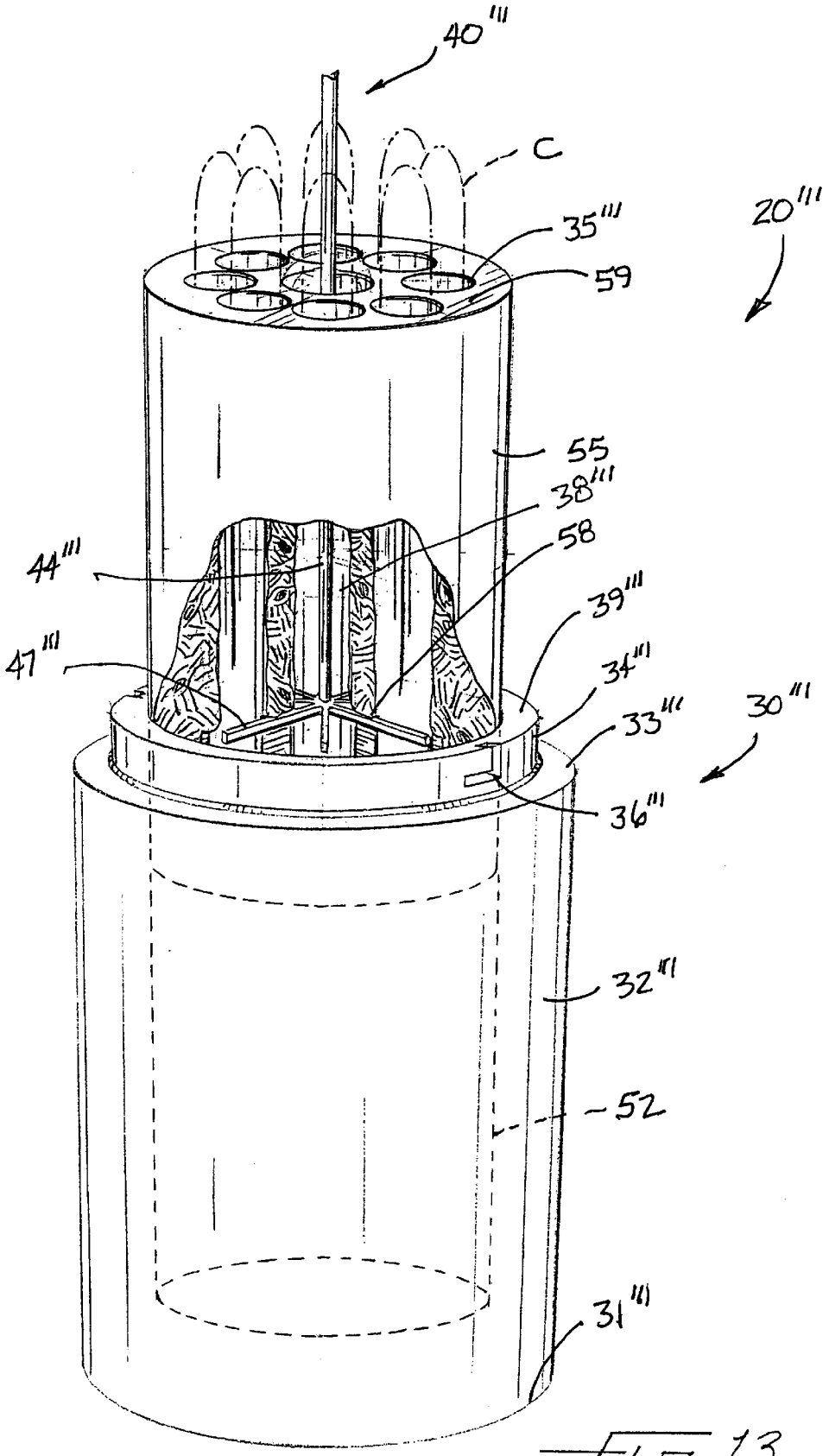
FIG. 13 is an exploded perspective view of a cigar storing apparatus without a lid according to a fourth embodiment of the present invention.

Advantageously, the bottom 31 and side portions 32 can be formed of a different material than the substantially solid medial portion 39 such as shown in FIG. 13. As in this fourth embodiment of the apparatus 20'", the bottom 31'" and side portions 32'" are formed of a metal material and the substantially solid medial portion 39'" is formed of a wood material, e.g., cedar. As shown in the other figures, namely FIGS. 1–12, the bottom 31, side portions 32, 32', 32", and substantially solid medial portion 39, 39', 39" can also each be formed of the same material such as a metal material or a wood material. Likewise, a casing or cover such as leather, vinyl, plastic or other material can also encase or surround the main container body 30, 30', 30", 30'" and/or the lid 25 of each of the embodiments of the apparatus 20, 20', 20", 20'".

As perhaps best shown in FIGS. 2–3, 5, 7–8, and 10–13 the main container body 30 of the apparatus 20 can also advantageously include a lip 33, 33', 33", 33'" substantially surrounding the upper end of the main container body 30 and a ridge extending upwardly from an inner edge of the lip 33, 33', 33", 33'". The peripheries of the container lid 25 engage the lip 33 and an outer face of the ridge 34 when in the closed position. The lid fastener preferably includes a slot or notch 36, 36'" formed in the ridge 34, 34'" of the main container body 30, 30'" and a pin member 28 extending inwardly from an inner surface of the container lid 25 and positioned to slidably engage the slot 36, 36'" when the container lid 25 is in the closed position to thereby secure the lid 25 to the main container body 30, 30'". This particular type of fastener can be advantageous in that threads and corresponding grooves can make the outer peripheries of upper portions of the container body 30 have a roughened surface. The smooth surface provides a sleek and upscale image and inhibits nicks or other damage from the peripheries of the container to the cigar C, users U, or clothing, e.g., sleeves. Nevertheless, other types of fasteners such as threads and grooves, various latches or locks, and hooks and loops can be used as well in association with the apparatus as understood by those skilled in the art.

As perhaps best shown in FIG. 13, a stock member 55, formed of a different material than the side portions 32'" of the main container body 30'" can be positioned in a stock chamber 52, e.g., bore, into the substantially solid medial portion 39'" of the main container body 30'". This fourth embodiment of the apparatus 20'", for example, can be easier to manufacture and construct, particularly in smaller volumes or for customized features, e.g., flavor dispensing to individual compartments 35'" which are formed in a substantially solid medial portion 59 of the stock member 58, or other desired benefits or features added to the apparatus 20'" as understood by those skilled in the art. Either the stock member 55 or the cigar dispenser 40 preferably has a dispenser stop, e.g., a stock member dispenser stop 58, associated therewith to limit the height H to which the cigars C extend. In this manner, the user U does not accidentally raise the cigars C to a level where all of the cigars C readily tumble from the cigar dispenser.

As illustrated in FIGS. 1–13, the present invention also advantageously includes a method 40 of displaying and dispensing cigars C which preferably includes positioning a plurality of cigars C in a cigar storage container 30 so that the plurality of cigars C are each substantially hidden from ready viewing and raising a cigar dispenser 40 to a desired height H responsive to a user U so that portions of each of the plurality of cigars C are readily visible to the user U. The step of raising a cigar dispenser 40 preferably includes gripping the cigar dispenser 40 by a hand of a user U and lifting the cigars C by the cigar dispenser 40 to the desired height H, e.g., from having lower ends thereof positioned adjacent the bottom 41 of the cigar storage compartments 35 by the use of finger slots 37 extending from the bore 38. The method can also include selecting one of the plurality of cigars C for use by gripping the cigar C with the other hand of the user U when the plurality of cigars C are being viewed.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. An apparatus for storing cigars, the apparatus comprising:

a main body container having a bottom, side portions connected to and extending upwardly from the bottom, and a plurality of cigar storage compartments formed within the main body, each having an open upper end thereof to position a cigar therein;

a container lid positioned to overlie upper portions of the main body container when in a closed position to thereby cover the open upper end of each of the plurality of cigar storage compartments;

a lid fastener associated with the container lid and the main body container to fasten the container lid to the main body container;

a seal positioned to contact the container lid and upper portions of the main body container to form a gaseous tight container so that when the lid is fastened to the main body container gases are not able to reach cigars in the plurality of cigar storage compartments; and a cigar dispenser carried by the main body container and responsive to a user to display and dispense each of the cigars within the plurality of cigar storage compartments;

the main body container including a bore formed therein extending from an upper end of the main body container to adjacent the bottom thereof;

the cigar dispenser including a handle rod positioned within the bore and having an upper end portion to be gripped by a user, and a lower end portion adjacent the bottom when in a lowered position and extending upwardly away from the bottom and through the bore when in a raised position.

2. An apparatus as defined in claim 1, wherein the main body container has a substantially solid medial portion positioned within the confines of the side portions and into which the plurality of separate, individual and elongate cigar storage compartments is formed.

3. An apparatus as defined in claim 2, wherein the bottom and side portions are formed of a different material than the substantially solid medial portion.

4. An apparatus as defined in claim 3, wherein the bottom and side portions are formed of a metal material, and wherein the substantially solid medial portion is formed of a wood material.

5. An apparatus as defined in claim 2, wherein the bottom, side portions, and substantially solid medial portion are each formed of a metal material.

6. An apparatus as defined in claim 1, wherein the container lid includes an inner layer comprising a wood material positioned to be adjacent and overlie the open upper end of each of the plurality of cigar storage compartments.

7. An apparatus as defined in claim 6, wherein the main body container includes a lip substantially surrounding the upper end of the main body container and a ridge extending upwardly from an inner edge of the lip, and wherein peripheries of the container lid engages the lip and an outer face of the ridge when in the closed position.

8. An apparatus as defined in claim 7, wherein the lid fastener includes a slot formed in the ridge of the main body container and a pin member extending inwardly from an inner surface of the container lid and positioned to slidably engage the slot when the container lid is in the closed position to secure the lid to the main body container.

9. An apparatus as defined in claim 7, wherein the seal has a substantially annular shape, is positioned on the lip, and is formed of an elastomeric material.

10. An apparatus as defined in claim 1, wherein the cigar dispenser also includes a plurality of cigar contact rod members connected to and extending outwardly from the handle rod and each to a respective one of plurality of cigar storage compartments and each positioned to underlie a respective one of the cigars so that when the handle rod is gripped and raised by a user at least portions of upper ends of the cigars extend upwardly through open upper end of the plurality of cigar storage compartments for simultaneously displaying and dispensing to a user.

11. An apparatus for storing cigars, the apparatus comprising:

a main body container having a bottom, side portions connected to and extending upwardly from the bottom, and a plurality of cigar storage compartments formed within the main body, each having an open upper end thereof to position a cigar therein;

a container lid positioned to overlie upper portions of the main body container when in a closed position to thereby cover the open upper end of each of the plurality of cigar storage compartments; and a cigar dispenser having carried by the main body container and responsive to a user to display and dispense each of the cigars within the plurality of cigar storage containers;

the main body container including a bore formed therein extending from an upper end of the main body container to adjacent the bottom thereof;

the cigar dispenser including a handle rod positioned within the bore and having an upper end portion to be gripped by a user, and a lower end portion adjacent the bottom when in a lowered position and extending upwardly away from the bottom and through the bore when in a raised position.

12. An apparatus as defined in claim 11, wherein the main body container has a substantially solid medial portion positioned within the confines of the side portions and into which the plurality of separate, individual and elongate cigar storage compartments is formed.

13. An apparatus as defined in claim 12, wherein the bottom and side portions are formed of a different material than the substantially solid medial portion.

14. An apparatus as defined in claim 13, wherein the bottom and side portions are formed of a metal material, and wherein the substantially solid medial portion is formed of a wood material.

15. An apparatus as defined in claim 12, wherein the bottom, side portions, and substantially solid medial portion are each formed of a metal material.

16. An apparatus as defined in claim 11, wherein the container lid includes an inner layer comprising a wood material positioned to be adjacent and overlie the open upper end of each of the plurality of cigar storage compartments.

17. An apparatus as defined in claim 11, wherein the main body container includes a lip substantially surrounding the upper end of the main body container and a ridge extending upwardly from an inner edge of the lip, and wherein peripheries of the container lid engage the lip and an outer face of the ridge when in the closed position.

18. An apparatus as defined in claim 17, further comprising a lid fastener associated with the container lid and the main body container to fasten the container lid to the main body container and a seal positioned to contact the container lid and upper portions of the main body container to form a gaseous tight container so that when the lid is fastened to the main body container gases are not able to reach cigars in the plurality of cigar storage compartments.

19. An apparatus as defined in claim 18, wherein the lid fastener includes a slot formed in the ridge of the main body container and a pin member extending inwardly from an inner surface of the container lid and positioned to slidably engage the slot when the container lid is in the closed position to fasten the lid to the main body container.

20. An apparatus as defined in claim 18, wherein the seal has a substantially annular shape, is positioned on the lip, and is formed of an elastomeric material.

21. An apparatus as defined in claim 11, wherein the cigar dispenser also includes a plurality of cigar contact rod members connected to and extending outwardly from the handle rod and each to a respective one of plurality of cigar storage compartments and each positioned to underlie a respective one of the cigars so that when the handle rod is gripped and raised by a user at least portions of upper ends of the cigars extend upwardly through the open upper end of the plurality of cigar storage compartments for simultaneously displaying and dispensing to a user.

22. An apparatus for storing cigars, the apparatus comprising:

a main body container having a bottom, side portions connected to and extending upwardly from the bottom, a substantially solid medial portion positioned within the confines of the side portions, a plurality of cigar storage compartments formed within the substantially solid medial portion, each having an open upper end thereof to position a cigar therein, the solid medial portion including a bore formed in a medial portion thereof;

a container lid positioned to overlie upper portions of the main body container when in a closed position to hereby cover the open upper end of each of the plurality of cigar storage compartments;

a lid fastener associated with the container lid and the main body container to secure the container lid to the main body container;

a seal positioned to contact the container lid and upper portions of the main body container to form a gaseous tight container; and a cigar dispenser within the bore and responsive to a user to display and dispense the cigars within the plurality of cigar storage containers;

the cigar dispenser including a handle rod within the bore and having an upper end portion to be gripped by a user and a lower end portion adjacent the bottom when in a lowered position and extending upwardly away from the bottom when in a raised position.

23. An apparatus as defined in claim 22, wherein the bottom and side portions are formed of a different material than the substantially solid medial portion.

24. An apparatus as defined in claim 22, wherein the bottom and side portions are formed of a metal material, and wherein the substantially solid medial portion is formed of a wood material.

25. An apparatus as defined in claim 22, wherein the bottom, side portions, and substantially solid medial portion are each formed of a metal material.

26. An apparatus as defined in claim 22, wherein the container lid includes an inner layer comprising a wood material positioned to be adjacent and overlie the open upper end of each of the plurality of cigar storage compartments.

27. An apparatus as defined in claim 26, wherein the main body container includes a lip substantially surrounding the upper end of the main body container and a ridge extending upwardly from an inner edge of the lip, and wherein peripheries of the container lid engage the lip and an outer face of the ridge when in the closed position.

28. An apparatus as defined in claim 27, further comprising a lid fastener associated with the container lid and the main body container to secure the container lid to the main body container.

29. An apparatus as defined in claim 28, wherein the lid fastener includes a slot formed in the ridge of the main body container and a pin member extending inwardly from an inner surface of the container lid and positioned to slidably engage the slot when the container lid is in the closed position to thereby secure the lid to the main body container.

30. An apparatus as defined in claim 29, wherein the seal has a substantially annular shape, is positioned on the lip, and is formed of an elastomeric material.

31. An apparatus as defined in claim 22, wherein the cigar dispenser also includes a plurality of cigar contact rod members connected to and extending outwardly from the handle rod and each to a respective one of plurality of cigar storage compartments and each positioned to underlie a respective one of the cigars so that when the handle rod is gripped and raised by a user at least portions of upper ends of the cigars extend upwardly through the open upper end of the plurality of cigar storage compartments for simultaneously displaying and dispensing to a user.

* * * * *